US005103482A

United States Patent [19]

Fabri-Conti

[11] Patent Number: 5,103,482

[45] Date of Patent: Apr. 7, 1992

[54] APPARATUS AND METHOD FOR REPRODUCING HIGH FIDELITY SOUND

[76] Inventor: Lucas Fabri-Conti, 3 Rue Gazan, Paris, France, 75014

[21] Appl. No.: 611,465

[22] Filed: Nov. 13, 1990

Related U.S. Application Data

[63] Continuation of Ser. No. 225,171, Jul. 28, 1988, abandoned.

[51] Int. Cl.[5] ..... H04R 25/00

[52] U.S. Cl. ..... 381/156; 181/152; 181/159

[58] Field of Search ..... 381/156, 204; 181/152, 181/159

[56] References Cited

U.S. PATENT DOCUMENTS

| | | | |
|---|---|---|---|
| 1,767,679 | 6/1930 | Hutchison . | |
| 1,957,562 | 5/1934 | Tolerton . | |
| 1,974,770 | 9/1934 | Engholm . | |
| 2,007,747 | 7/1935 | Ringel | 381/204 |
| 2,039,856 | 5/1936 | Taber . | |
| 2,058,208 | 10/1936 | Blattner . | |
| 2,105,934 | 1/1938 | Stevens . | |
| 2,112,473 | 3/1938 | Tolerton . | |
| 2,115,924 | 5/1938 | Fisher | 181/163 |
| 2,269,284 | 1/1942 | Olson | 381/156 |
| 2,295,527 | 9/1942 | Bowley . | |
| 2,441,975 | 5/1948 | Roberton . | |
| 2,548,235 | 4/1951 | Olson . | |
| 2,646,853 | 7/1953 | Pocock . | |
| 2,852,089 | 9/1958 | Cohen et al. | 381/156 |
| 3,032,136 | 5/1962 | Hegeman, Jr. | 181/159 |
| 3,185,767 | 5/1965 | Olson et al. . | |
| 3,649,776 | 3/1972 | Burton | 381/156 |
| 3,767,004 | 10/1973 | Liebscher . | |
| 3,866,710 | 2/1975 | Cesati . | |
| 4,283,606 | 8/1981 | Buck | 381/204 |
| 4,310,065 | 1/1982 | Kayman . | |
| 4,327,257 | 4/1982 | Schwartz . | |
| 4,437,540 | 3/1984 | Murakami et al. | 181/152 |
| 4,525,604 | 6/1985 | Frye . | |

FOREIGN PATENT DOCUMENTS

| | | | |
|---|---|---|---|
| 77228 | 4/1983 | European Pat. Off. | 381/156 |
| 673844 | 1/1930 | France | 381/156 |
| 382863 | 11/1932 | United Kingdom | 381/156 |

*Primary Examiner*—Forester W. Isen
*Assistant Examiner*—D. Byrd
*Attorney, Agent, or Firm*—Banner, Birch, McKie & Beckett

[57] ABSTRACT

A horn-equipped loudspeaker is provided which has an electro-acoustic transducer to convert electrical signals into acoustical signals, a coil with input terminals for receiving the electrical signals and at least one movable diaphragm for the emission of acoustical signals. The loudspeaker also includes a horn with walls arranged facing each other. The separation between the horn walls progressively increases from a small input area, or throat, to a large output region, or mouth. The loudspeaker diaphragm is formed of a portion of one of the walls of the input area of the horn.

9 Claims, 4 Drawing Sheets

APPARATUS AND METHOD FOR REPRODUCING HIGH FIDELITY SOUND

This application is a continuation of application Ser. No. 225,171, filed July 28, 1988, now abandoned.

BACKGROUND OF THE INVENTION

The present invention generally relates to the field of electro-acoustical devices, and more particularly, is directed to an apparatus and method for producing high fidelity sound.

Electro-acoustical devices, or loudspeakers, emit variable acoustic pressures as a function of variations in the electrical signals that are fed into them. Such devices are formed of two main parts. The first is a transducer having electrical input terminals for the feeding of electrical signals and a movable output component whose displacements are linked to variations in the electrical signals. The second part is a movable component in the shape of a plate or diaphragm connected mechanically to the movable transducer component which ensures the emission of acoustic radiation corresponding to the electrical signals fed into the device.

Devices of this type have been widely distributed but normally exhibit a serious problem arising from the output obtained from the conversion of the energy applied to product displacement of the movable diaphragm. Indeed, the acoustic coupling associating the direct-projection diaphragm and the air produces a low-level output since the respective acoustic impedances of the diaphragm (high impedance) and the air (low impedance) are very different.

For this reason, loudspeakers have been built utilizing an acoustic impedance converter, i.e., a hollow funnel or horn in the general shape of a cone having a curved generator. This curve will, most advantageously, be exponential. The conversion of acoustic impedance takes place in the area located between the small section of the horn, or "throat," which corresponds to high impedance levels and where the movable diaphragm is installed, and the main portion of the horn, or "mouth," which corresponds to low impedance levels and which leads directly to the outside.

However, for a given mouth surface, the search for a high conversion ratio dictates a very small throat area. Consequently, this also leads to a small surface-area of the loudspeaker diaphragm, and thus, to severe limits to the power obtained from the loudspeaker.

To overcome these limits, it has been suggested that a cavity, or intermediate chamber, be placed between the movable diaphragm and the entrance to the throat. In this way, the surface-area of the diaphragm could be greater than that of the throat. Transmission of acoustical energy between the diaphragm and the throat would occur by means of the compression of air confined in the chamber.

This type of compression-chamber loudspeaker possesses, however, a serious disadvantage. The transmission of acoustical energy between the diaphragm and the throat, and therefore, the proper functioning of the loudspeaker, takes place only within a limited frequency range or band toward the treble frequencies. The compression chamber produces real attenuation in this zone.

Reducing the distance between the diaphragm and the throat permits raising of the cutoff frequency but introduces the risk of accidental contact of the diaphragm and the mouth during high-amplitude displacements in the bass range. Thus limiting, here again, the power that may be obtained from the loudspeaker. Furthermore, it should be noted that acoustical emission from this type of loudspeaker is severely directional, and occurs in the axis of the horn. In order to provide for a sizable angle of emission, typically on the order of 40°, multiple horns, juxtaposed one to the others, or multi-cellular horn, must be used.

FIG. 1 illustrates a horn-equipped loudspeaker according to conventional technology. It is comprised of an electro-acoustic transducer and a device for acoustic coupling with the air. The transducer contains, first, a coil of conducting wire 1 with two terminals 2 and 3. The coil is immersed in a magnetic field created by a magnet 4. The transducer contains, second, a movable diaphragm 5 to which the coil is attached. The air-coupling device contains a cavity or chamber 6 connected to a hollow horn 7 and having a small input opening 8, or "throat," and a large output opening 9, or "mouth."

A loudspeaker of this type operates in the following way. The feeding of A.C. electric voltage into the input terminal 2, 3 causes displacement of the moving coil 1 acted upon by the magnetic field created by the magnet 4, and, as a result, displacement of the transducer diaphragm 5. The acoustical energy thus created is propagated across the chamber 6 toward the output throat 8 of the horn from which it is finally emitted to the outside through the mouth 9.

The surface-area of the throat 8 must be small, to ensure effective coupling, i.e., adaptation of acoustic impedance, with the large surface-area of the mouth 9. However, the surface-area of the diaphragm 5 must be large, in order to produce a high level of acoustic power. These contradictory requirements are reconciled by the presence of a chamber or cavity 6, whose internal air volume transmits acoustical energy as a result of the elevated compressions and depressions which take place there, thus obtaining acoustical impedance adaptation between the diaphragm 5 and the throat 8.

However, the use of a compression chamber 6 constitutes a serious disadvantage, mentioned previously, consisting of the limitation of the transmission of treble frequencies and leading to an elevated "cutoff frequency" beyond which acoustical energy is no longer transmitted.

SUMMARY OF THE INVENTION

The loudspeaker of the present invention overcomes the above mentioned disadvantages of prior art speakers.

One of the objectives of the present invention is to provide a horn-equipped loudspeaker containing a movable diaphragm whose dimensions are significantly greater than those of the throat of its horn without requiring recourse to a compression chamber.

Another objective of the present invention is the creation of a horn-equipped loudspeaker permitting sizable displacements of the moving coil without risking accidental contact of the diaphragm and the mouth.

A still further object of the present invention is to provide a horn-equipped loudspeaker ensuring acoustic emission in an angle extending up to 360°.

In the horn-equipped loudspeaker of the present invention, a portion of the horn wall, which is located in the area of the throat and which is made up of the diaphragm responsible for the emission of acoustic radiation, is made movable. More particularly, the loudspeaker of the present invention is formed of an electro-acoustic transducer which converts electrical signals into acoustic signals, a coil equipped with input terminals for the application of the electrical signals and at least one movable diaphragm for the emission of the acoustic signals. A hollow horn with conically-shaped walls forming a small input area or throat and a large output area or mouth is also provided. The speaker diaphragm is formed of a portion of the walls of the input area of the horn.

BRIEF DESCRIPTION OF THE DRAWINGS

The invention may be better understood using the following description based on the attached drawings, in which.

DESCRIPTION OF THE PREFERRED EMBODIMENT

Figure 1:
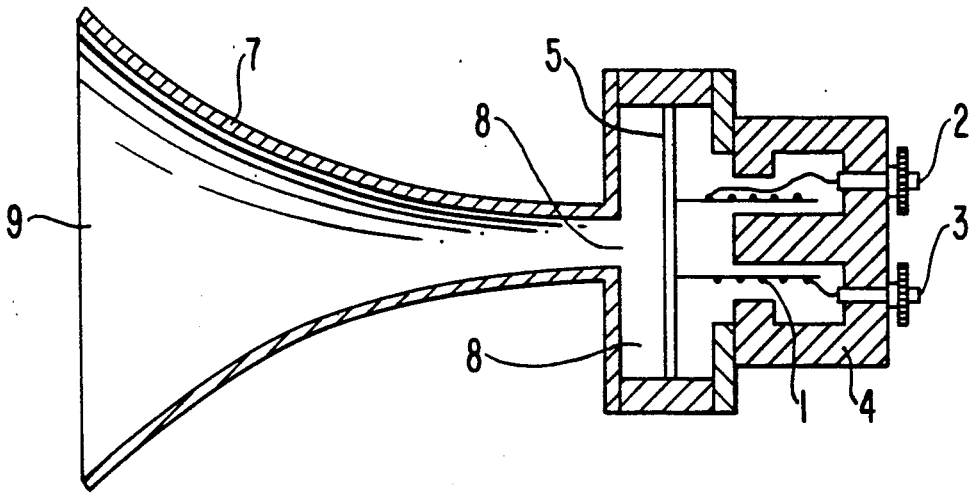
FIG. 1 (PRIOR ART)
FIG. 1 illustrates a horn-equipped loudspeaker as known in the prior art.
Figure 2:
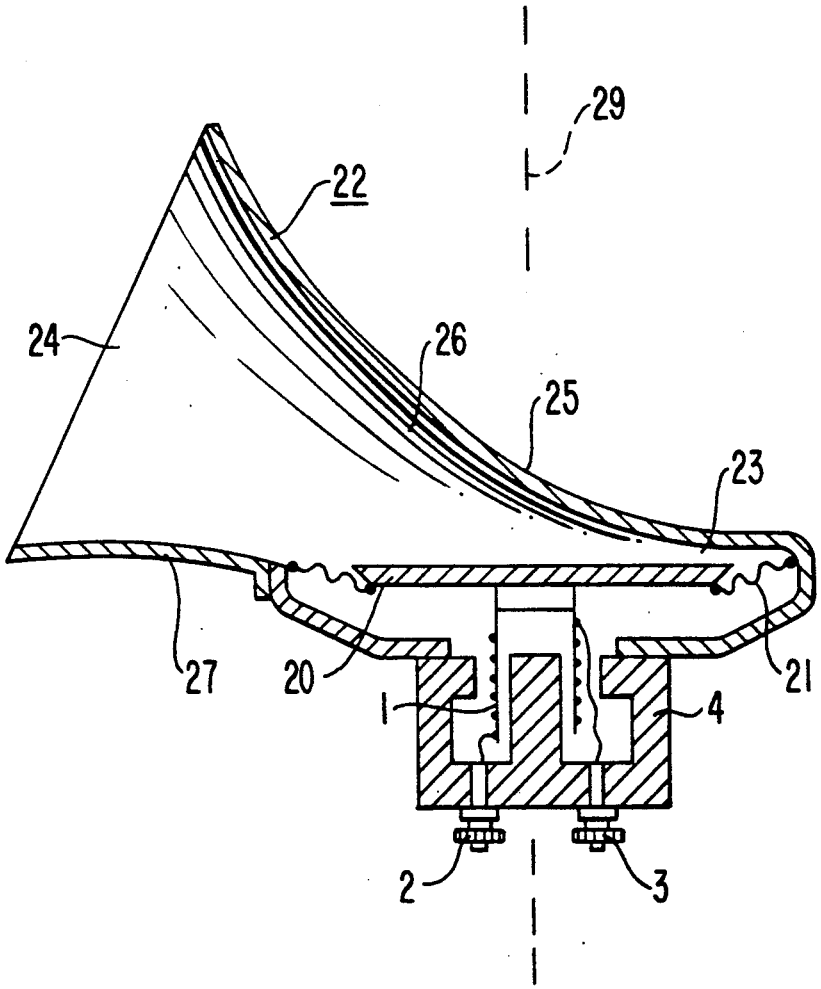
FIG. 2 illustrates a first embodiment of a loudspeaker according to the present invention.

FIG. 2 illustrates a first embodiment of the horn-equipped loudspeaker according to the present invention. It contains an electro-acoustic transducer and a device ensuring acoustical coupling with the air. The electro-acoustic transducer contains a conducting coil 1 with two terminals 2, 3 and is immersed in the magnetic field created by a magnet 4. It also contains a movable diaphragm 20, whose edges are supported by a flexible suspension, such as 21, to which the coil is fastened.

The air-coupling device is formed of a hollow horn 22, with a throat, an input area 23, and an output area 24, or mouth. The movable diaphragm of the electro-acoustic transducer is formed of a portion of the walls of the input area of the horn.

A loudspeaker in accordance with the above described construction produces a progressive conversion of the acoustic impedance between the diaphragm and the horn without requiring an intermediate compression chamber. As a result, it has no limits to the transmission of treble frequencies between the diaphragm and the horn. There is no elevated "cutoff frequency."

According to the invention, operation of the conversion of acoustical impedance between the transducer and the horn of the loudspeaker depends on the progressively-increasing distance separating the two walls of the horn located in the input area. Within the horn, one of the walls 25 is stationary, and the other 27 is partially made up of the movable diaphragm 20.

In the first portion of input area 23, displacements of the diaphragm involves a small volume of air and as a result of the short distance to the wall, causes substantial variations in pressure. In the final output area 26, on the other hand, the displacements of the diaphragm involves large volumes of air and creates slight variations in pressure as a result of the substantial distance between the diaphragm and the walls arranged opposite to each other.

Furthermore, at distances further from the input area 23, the accumulated impedances of the preceding sections of volume remains greater than the impedance of the following section. In addition, the respective volumes and pressure variations vary inversely between the input 23 and output 26 regions of the horn. This phenomenon effectively constitutes the desired conversion of acoustic impedance.

Figure 3:
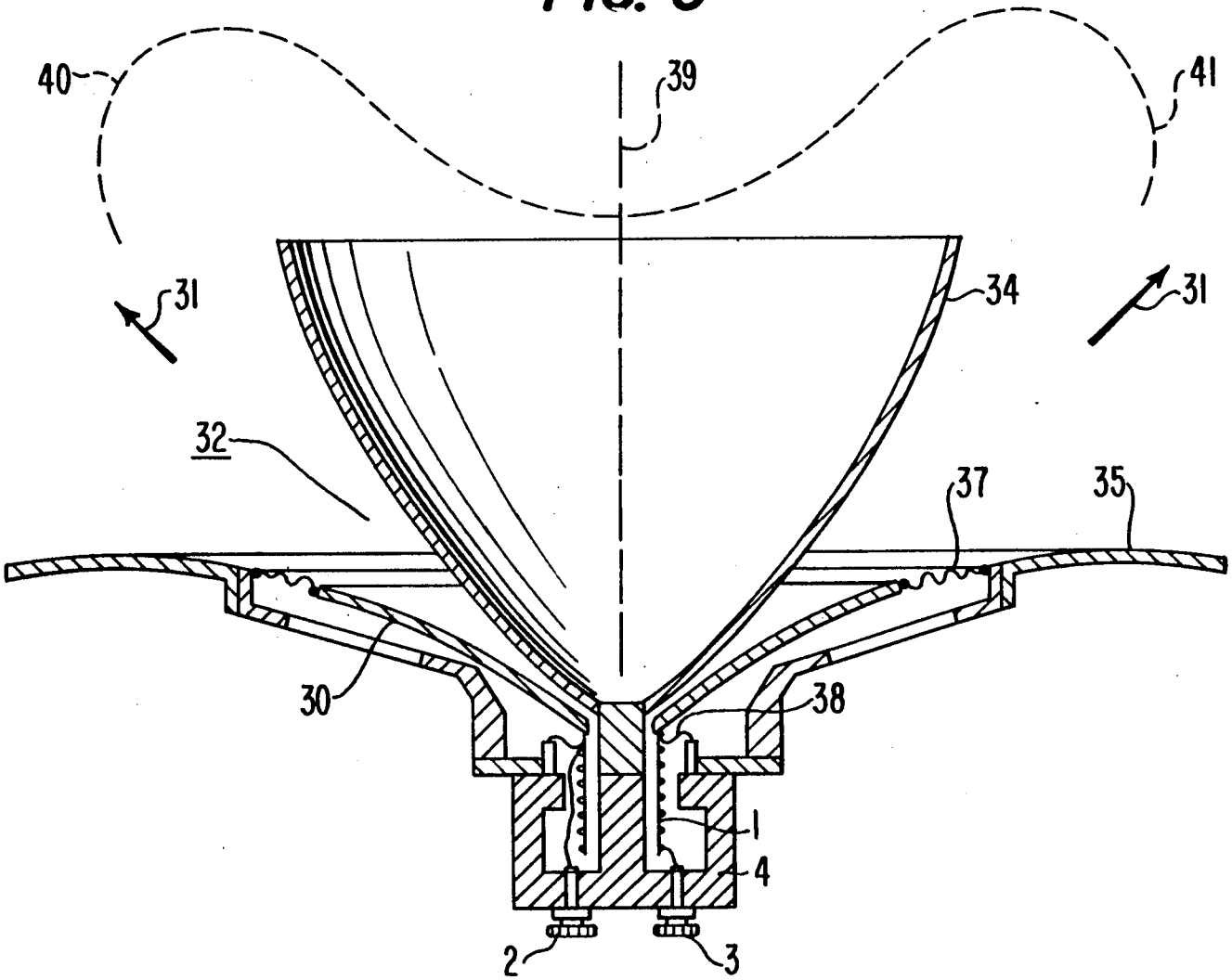
FIG. 3 illustrates a second embodiment of a loudspeaker according to the present invention.

FIG. 3 shows a second embodiment of a loudspeaker according to the invention which incorporates rotational symmetry. This embodiment results from a 360° rotation of the structure of the horn-equipped loudspeaker shown in FIG. 2 around an axis of symmetry 39.

All of the loudspeaker components share this axis of symmetry. The electro-acoustic transducer contains a moving coil 1 which activates a diaphragm 30 held in place by flexible suspensions, such as 37 and 38. In accordance with this embodiment, the diaphragm is a component of the input area of hollow horn 32 having conically-shaped walls such as 34 and 35. Operation is identical to that of the loudspeaker shown in FIG. 2 and produces acoustical energy emitted mainly in the directions shown in FIG. 3 along the axis of symmetry 39. The energy-emitted surface also produces two lobes 40 and 41.

Figure 4:
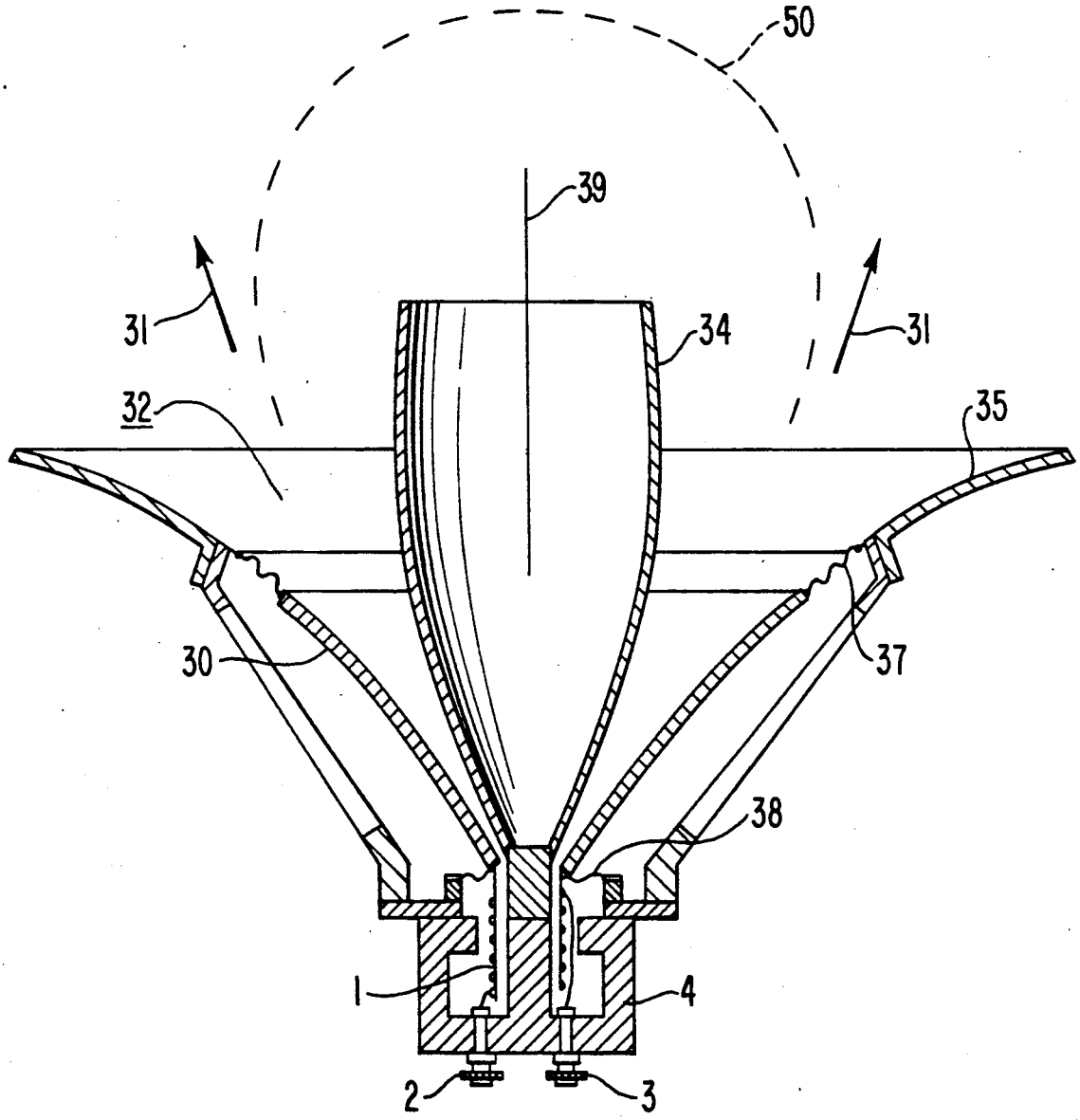
FIG. 4 illustrates a variation of the second embodiment of the horn-equipped loudspeaker according to the present invention.

FIG. 4 shows a variant of the embodiment of the loudspeaker shown in FIG. 3. In this embodiment an energy-emitting surface having one lobe 50 is provided which insures excellent directivity in the direction of the axis of symmetry 39. This result is achieved by a reduction in the angle formed by the conical diaphragm 30 and its axis of symmetry.

It should be obvious from the above-discussed apparatus embodiment that numerous other variations and modifications of the apparatus of this invention are possible, and such will readily occur to those skilled in the art. Accordingly, the scope of this invention is not to be limited to the embodiment disclosed, but is to include any such embodiments as may be encompassed within the scope of the claims appended hereto.

I claim:

1. In a loudspeaker, having an electro-acoustic transducer which converts electrical signals into acoutical signals, a coil having input terminals for the feeding of said electrical signals, at least one movable diaphragm for the emission of said acoustical signals, a hollow horn with walls placed opposite to each other with progressively increasing separation between them, wherein said horn having a small input area and a large output area, the improvement comprising:

said diaphragm being formed of a portion of one of the walls of said horn in said input area, said hollow horn being stationary except for the portion of said one wall which form said diaphragm.

2. A loudspeaker according to claim 1, wherein said walls of said horn and said diaphragm are formed of rotational surfaces around a common axis of symmetry.

3. A loudspeaker according to claim 2, wherein said movable diaphragm is displaced by the action of said electric coil, said coil being displaced in a magnetic circuit, said diaphragm, said coil, and said magnetic circuit having the same axis of symmetry.

4. A loudspeaker according to claim 1, wherein the spacing between the walls of said horn is in accordance with an exponential function.

5. A sound reproducing device, said device comprising:

a horn having side walls separated by a progressively increasing distance;

an electric coil having input terminals for receiving an electrical signal corresponding to a sound to be reproduced;

magnetic means for producing a magnetic field around said electric coil; and a movable diaphragm coupled to said coil and adapted to move in accordance with said electrical signal, said diaphragm being formed as a portion of one of said side walls, said horn being stationary except for said portion of said one wall which forms said diaphragm.

6. A sound reproducing device according to claim 5, wherein said diaphragm is suspended along said side wall by spring means for permitting said diaphragm to free move in response to said electric signal.

7. A sound reproducing device according to claim 5, wherein said side walls are formed of rotational surfaces around a common axis of symmetry.

8. A sound reproducing device according to claim 5, wherein said diaphragm and said magnetic means have the same axis of symmetry as the side wall opposite said diaphragm.

9. A method of producing high fidelity sound from a loud speaker having side walls separated by progressively increasing distances, an electric coil having an input terminal for receiving an electrical signal corresponding to a sound to be reproduced, wherein said coil is surrounded by a magnetic field and is coupled to be a diaphragm which is adapted to move in accordance with said electrical signal, said method comprising the step of:

forming said diaphragm as a portion of one of said side walls, said side walls being stationary except for the portion of said one wall which forms said diaphragm.

* * * * *